US006991319B2

(12) United States Patent
Zerza et al.

(10) Patent No.: US 6,991,319 B2
(45) Date of Patent: Jan. 31, 2006

(54) SELECTING A COLOR SCHEME FOR PRINTING ACCORDING TO ESTIMATES OF INK USAGE

(75) Inventors: Wendy L. Zerza, Boise, ID (US); Vincent C. Skurdal, Boise, ID (US); Boyd R. Wilkes, Nampa, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 71 days.

(21) Appl. No.: 10/405,274

(22) Filed: Apr. 2, 2003

(65) Prior Publication Data

US 2004/0196331 A1 Oct. 7, 2004

(51) Int. Cl.
*B41J 2/21* (2006.01)

(52) U.S. Cl. ..... 347/43; 347/15; 347/14

(58) Field of Classification Search ..... 347/15, 347/43, 14, 16, 19

See application file for complete search history.

(56) References Cited

U.S. PATENT DOCUMENTS 5,682,140 A 10/1997 Christensen et al.
5,812,156 A 9/1998 Bullock et al.
5,918,238 A 6/1999 Hayashi et al.
6,196,663 B1 * 3/2001 Wetchler et al. ..... 347/43
6,275,664 B1 8/2001 Wolf et al.
6,336,705 B1 * 1/2002 Torigoe ..... 347/43
6,486,981 B1 11/2002 Shimura et al.
6,498,912 B1 12/2002 Leni et al.
6,507,824 B1 1/2003 Yon et al.
6,509,919 B1 1/2003 Tehranchi et al.
6,533,393 B1 3/2003 Meyer et al.

* cited by examiner

*Primary Examiner*—Lamson Nguyen

(57) ABSTRACT

A method for printing includes estimating ink usage for printing with a first color scheme and a second color scheme, and selecting between the first color scheme and the second color scheme for printing according to the estimating of the ink usage. An apparatus includes a first sensor to measure a level of a first ink, a second sensor to measure a level of a second ink, and a processor coupled to the first sensor and the second sensor and configured to estimate usage of the first ink and the second ink using a first color scheme and a second color scheme and configured to select the first color scheme or the second color scheme for use in printing according to the estimate of the usage of the first ink and the second ink.

45 Claims, 5 Drawing Sheets

SELECTING A COLOR SCHEME FOR PRINTING ACCORDING TO ESTIMATES OF INK USAGE

BACKGROUND INFORMATION

Inkjet printing mechanisms may use cartridges, often called "pens," which eject drops of liquid colorant, referred to generally herein as "ink," onto a page. Each pen may include a printhead formed with very small nozzles through which the ink drops are fired. To print an image, the printhead is propelled back and forth across the page, ejecting drops of ink in a desired pattern as it moves. The particular ink ejection mechanism within the printhead can include a piezo-electric or a thermal printhead mechanism.

The inks used in an inkjet printer may be supplied from a reservoir of an inkjet cartridge. Some cartridges are monochrome and carry a single color such as black ink. Other cartridges are multi-color, and may include reservoirs that carry the three ink colors of cyan, magenta and yellow used for mixing, with black ink, to form most other colors. The multi-color cartridges maybe said to include three color "pens" while the monochrome color cartridges include one "pen". There are also printing mechanisms that use four monochrome cartridges. In systems that use multi-color cartridges, when one of the "pens" or color reservoirs is emptied, the entire cartridge is replaced. The result is that any remaining color in any unemptied reservoir is wasted.

The choice of colors to use and print may be designated by the computer user. In some instances, the colors selected are fixed, such as for color pictures, natural images, logos or replications. In other instances, the colors selected for print-outs maybe based on the preference of the computer user. The personal preference of the computer user may lead to repeated use of a particular color scheme that may empty the ink in one reservoir and result in wasting the ink in other reservoirs. For example, a user that makes many presentations as part of his job may use one favored color scheme for most of the power point slide presentations he develops. The preferred color scheme can be one of several color scheme templates that is part of the presentation software or the preferred color scheme may be totally selected by the computer user. In any event, repeated use of a color scheme can lead to wasted ink in one or more of the reservoirs of a multi-color cartridge.

DETAILED DESCRIPTION

The embodiments illustrated are described in sufficient detail to enable those skilled in the art to practice the teachings disclosed herein. Other embodiments may be utilized and derived therefrom, such that structural and logical substitutions and changes may be made without departing from the scope of present inventions. The following detailed description, therefore, is not to be taken in a limiting sense, and the scope of various embodiments of the invention is defined only by the appended claims, along with the full range of equivalents to which such claims are entitled.

Figure 1:
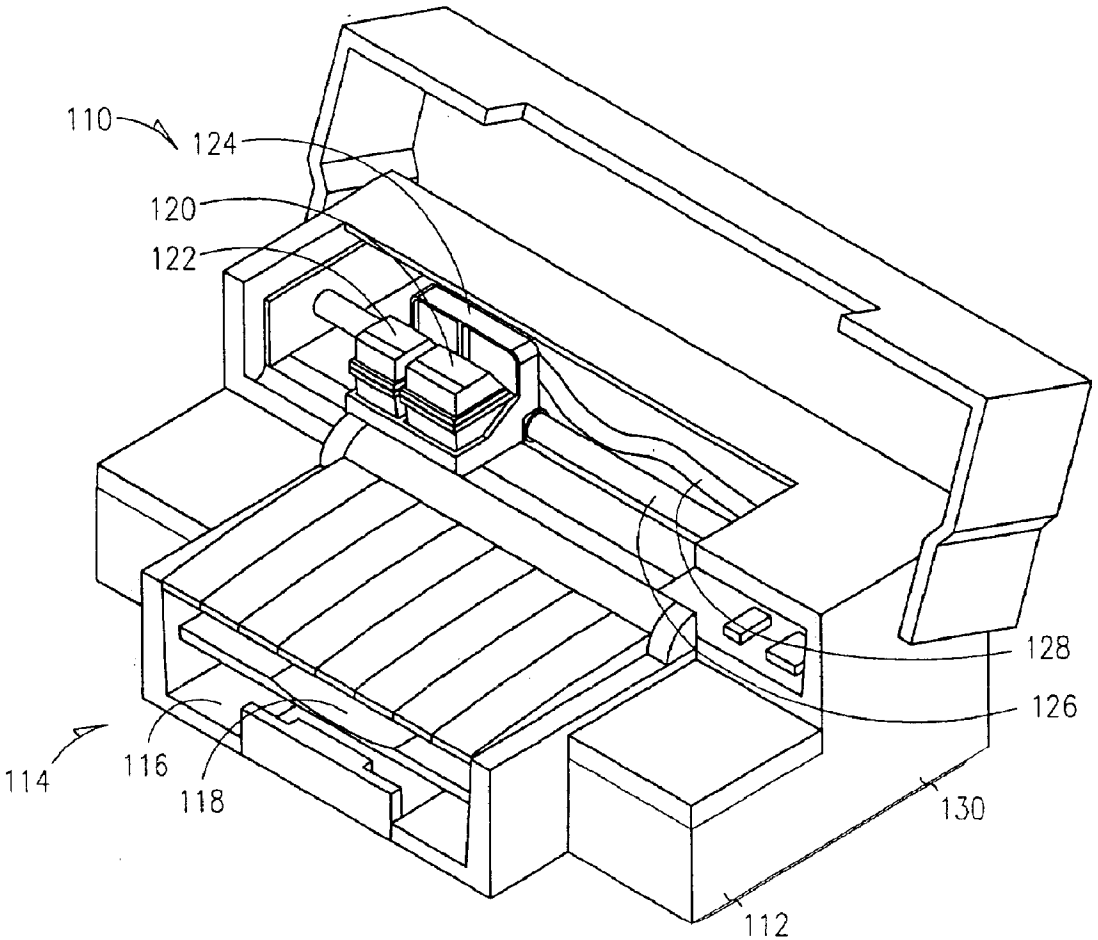
FIG. 1 is a perspective view of a printing apparatus according to one embodiment of the invention.

FIG. 1 shows one embodiment of a printing device. FIG. 1 includes an inkjet printer 110, which may be used in an office or home environment for business reports, correspondence, desktop publishing, pictures and the like. The inkjet printer 110 includes a chassis 112 and a print medium handling system 114 for supplying a print medium, such as a sheet of paper or high-quality photo paper (not shown), to the printer 110. In addition to paper, the print medium may be any type of suitable sheet material, such as card-stock, transparencies, mylar, foils, and similar print medium. The print medium handling system 114 includes a feed tray 116, an output tray 118, and a series of rollers (not shown) for delivering the sheets of paper from the feed tray 116 into position for receiving ink from a plurality of inkjet cartridges 120, 122. As illustrated, inkjet cartridge 120 is a tri-color pen color ink cartridge. Inkjet cartridge 122 is a black monochrome ink cartridge. It should be noted that the term pen is sometimes used in place of cartridge. In other instances the term pen may refer to the mechanism and reservoir for printing one color. For example, a multi-color cartridge that holds three colors may be referred to as three separate pens.

The ink cartridges or pens 120, 122 are transported by a carriage 124 which may be driven along a guide rod 126 by a drive belt/pulley and motor arrangement (not shown). The pens 120, 122 selectively deposit one or more ink droplets on a sheet of paper or other medium in accordance with instructions received via a conductor strip 128 from a printer controller 130 located within chassis 112, for instance at the location shown in FIG. 1. The controller 130 generally receives instructions from a computer (shown in FIG. 2), such as a personal computer. A monitor (shown in FIG. 2) coupled to the computer can be used to display visual information to an operator, such as the printer status or a particular program being run on the computer. Screens on the monitor are one form of user interface to the printer 110. It should be noted, that the inkjet printer 110 shown is an example of one type of printer that employs an embodiment of this invention. The various embodiments of the invention described herein are not limited to this one example model of a printer and can be used in any type of printer that uses any type of printing mechanism.

Figure 2:
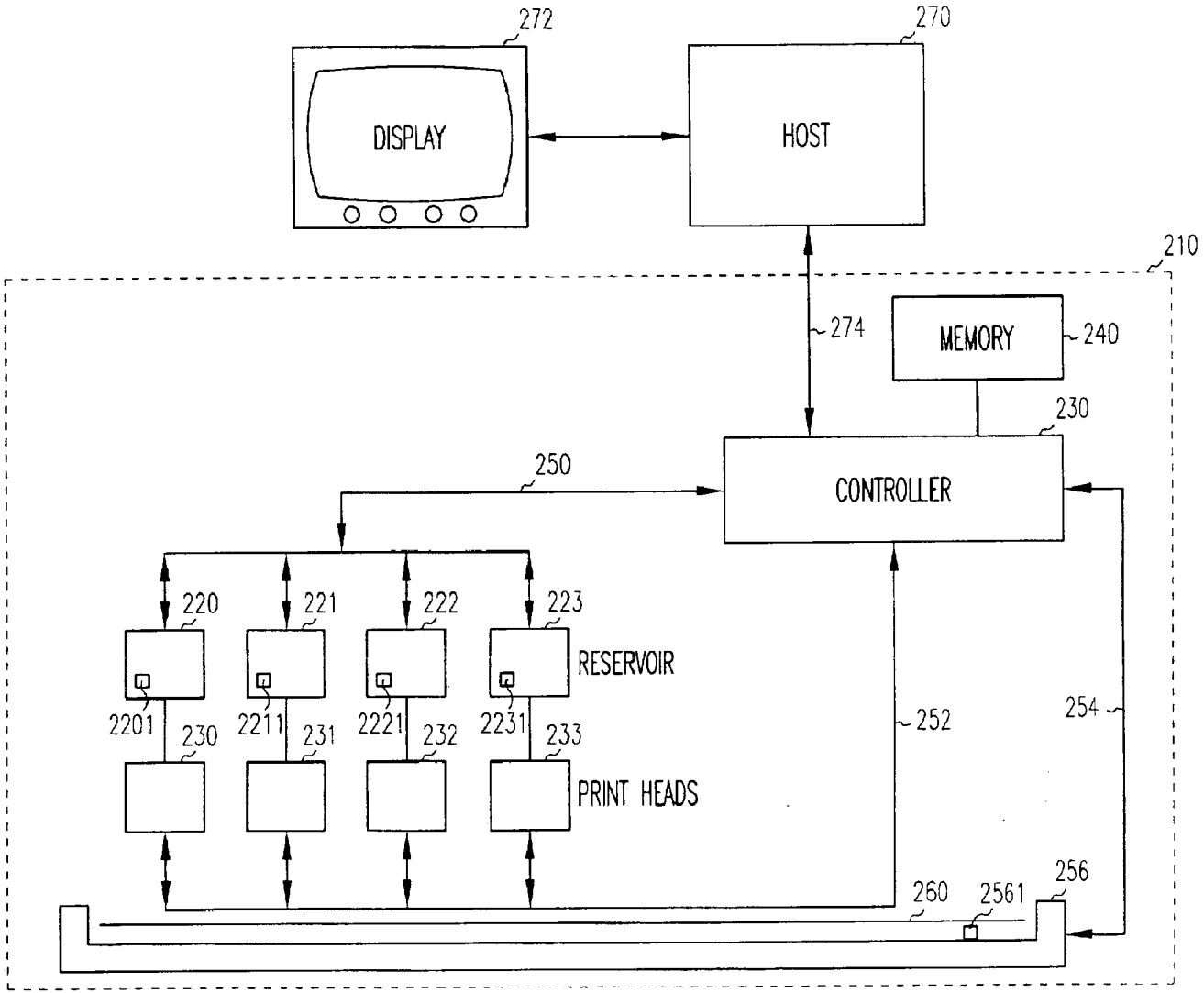
FIG. 2 is a schematic view of a printing apparatus that includes the printer controller and a host computer according to an embodiment of the invention.

FIG. 2 is a schematic view of a printing apparatus that includes a printer controller and a host computer according to an embodiment of this invention. The controller 230 controls many aspects of the printer. The controller 230 controls the transfer of information between ink reservoirs 220, 221, 222 and 223 and controller 230, as well as the control of information between the printheads 230, 231, 232 and 233 and controller 230. Much of the information is obtained from memory or a storage device 240. The memory 240 includes an indication of the type of ink and the ink colors in the various reservoirs 220, 221, 222, and 223. The memory 240 also contains information as to the levels of ink within the various reservoirs 220, 221, 222, 223. A fluid level sensor 2201, 2211, 2221, and 2231 is located to monitor the level of each of the various reservoirs 220, 221, 222, 223, respectively. The fluid level determined by the fluid level sensor 2201, 2211, 2221, and 2231 is placed into memory 240. Electrical contacts associated with each of the reservoirs 220, 221, 222, 223 receive signals over conductive paths represented by the line 250.

The controller 230 also selectively activates each printhead 230, 231, 232, 233 to eject or deposit ink from the respective reservoirs 220, 221, 222, and 223 onto a print media 260. The printheads 230, 231, 232, 233 are controlled by line 252 that sends signals to the printheads from the controller 230. The printheads 230, 231, 232 and 233 are also capable of providing signals to the controller. In some embodiments, there can be one printhead 230, 231, 232 or 233, associated with more than one reservoir 220, 221, 222, and 223. In the case of a tri-color cartridge, there are three reservoirs 221, 222, and 223 associated with a single printhead. In some embodiments, the signals provided to the controller 230 are feedback signals associated with a feedback control loop. A line 254 is attached to a printer mechanism 256 for controlling media transport and movement of a carriage, such as a tray or carriage 124, 224. In one embodiment, attached or associated with the printer mechanism 256 is a media type sensor 2561. The media type sensor senses the type of media 260 associated with a particular print job. The media type sensor can be any type of sensor, including a sensor for reading indicia. The indicia that can be read with different types of sensors 2561 include bar codes, labels, switch bumps, magnetically readable media, radio frequency label or read-only chips. It should be understood that other types of sensors can be used in place of the indicia reading sensors.

The controller 230 is also communicatively coupled to a host computer 270. The host computer 270 is shown connected to a display device 272. The host computer 270 can be a variety of information sources such as a personal computer, work station, or server, to name a few, that provide image information to the controller 230 by way of a data link 274. The data link 274 may be any one of a variety of data links such as an electrical link, radio frequency link, or an infrared link. The data link transfers information between the host computer 270 and the printing apparatus 210. The printing apparatus includes the entire schematic arrangement shown in FIG. 2. Generally, the dotted line box, designated by the reference number 210, includes the components associated with the printer.

Various parameters can be stored in the storage device or memory 240, including an actual count of ink drops emitted from a particular printhead 230, 231, 232, 233, data associated with an ink reservoir or container 220, 221, 222, 223, as well as the ink type and color, the container size, the age of the ink, the printer model or identification number, and cartridge usage information. Also stored within the memory is information on the print media 260, which in one embodiment, is obtained from media type sensor 2561. In other embodiments, a print command includes an indication of the paper type and information can be obtained from the print command regarding the type of print media being used. For example, in embodiments of printers where multiple paper trays are available, the type of print media must be designated as relating to a particular tray. In other embodiments, the resolution setting indicates that high-quality photo type print media is being used. The parameters listed above are just examples of the listings of parameters storable within the memory 240.

The controller 230 is included in an information handling system and may be either a microprocessor or a dedicated controller. An information handling system is any device that stores, manipulates or handles information such as data. The controller is capable of detecting the colors within the reservoirs 220, 221, 222, 223, by detecting a color from indicia associated with the reservoirs 220, 221, 222, 223. Indicia can be any type of readable indicator including bar codes, switch bumps, magnetically readable media, radio frequency label or read-only chips. In one embodiment, data associated with ink within a cartridge or reservoir 220, 221, 222, 223 is obtained through electrical contacts associated with the cartridge or reservoir 220, 221, 222, 223. The host computer 270 can include commands in a print command sent from the host 270 over the data link 274.

Figure 3:
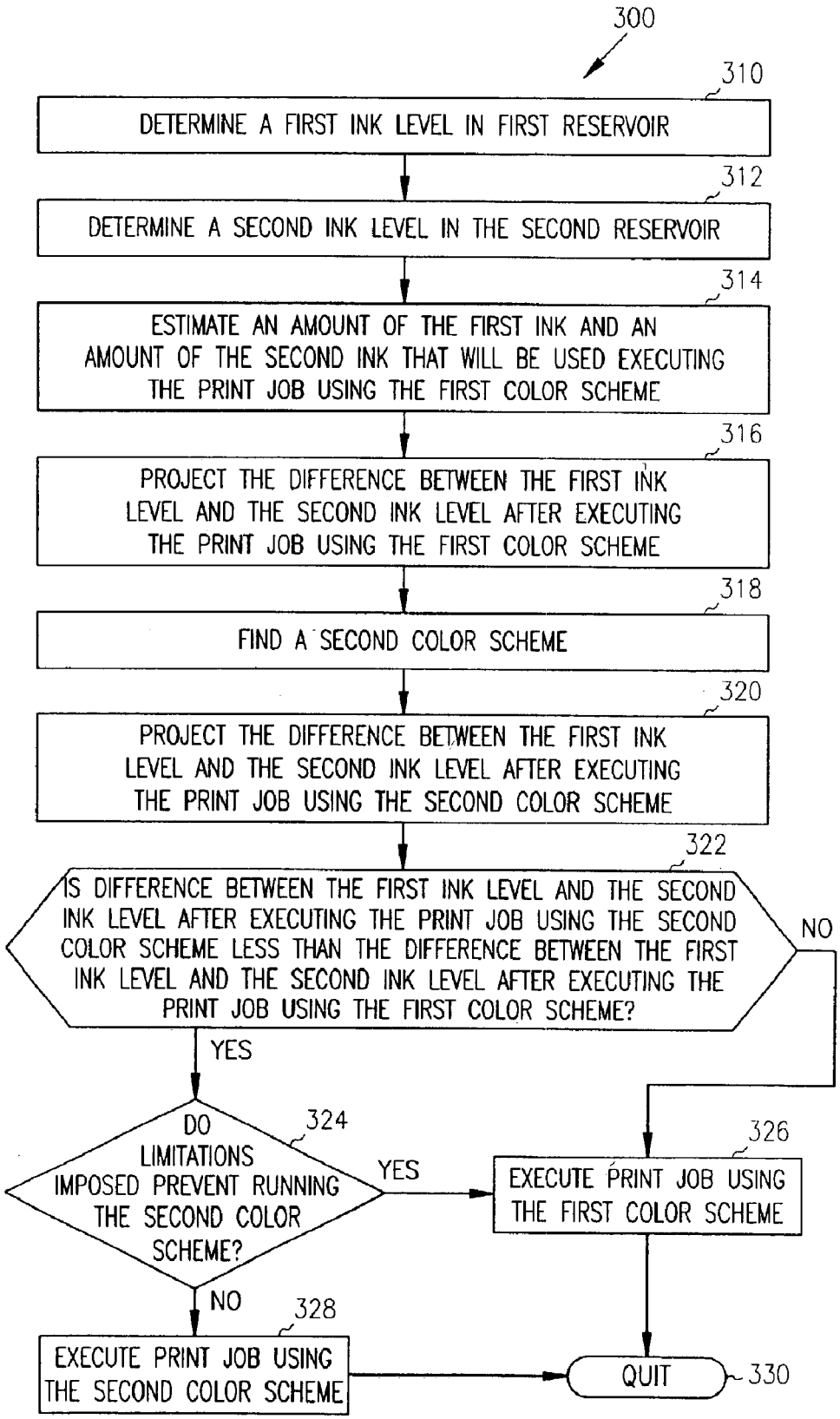
FIG. 3 is a flow diagram illustrating a method according to an embodiment of the invention.

FIG. 3 is a flow diagram 300 illustrating a method according to an embodiment of the invention. Initially, a first ink level in a first reservoir 221 is determined, as depicted by reference numeral 310. Next, a second ink level in a second reservoir 222 is determined, as depicted by reference numeral 312. Generally, the fluid level sensors 2211 and 2221 are used to determine the first ink level in the first reservoir 221 and the second ink level in the second reservoir 222, respectively. Each print command or print job has a color scheme associated with the print job. Generally, the user selects the first print scheme to be associated with the print job. A user may choose a print scheme based upon a default value in a software program or also may choose a custom print scheme where all the colors associated with the print scheme are selected. Next in the method is analyzing the first color scheme or original color scheme to estimate an amount of a first ink and an amount of a second ink that will be used to execute a print job using the first color scheme, as depicted by reference numeral 314. Using the given analysis, the differences between the first ink level in the first reservoir 221 and the second ink level in the second reservoir 222 is estimated or projected when using the first color scheme associated with the print command, as depicted by reference numeral 316. A second color scheme is then found or proposed, as depicted by reference numeral 318, and the difference between the first ink level of the first ink reservoir 221 and the second ink level associated with the second ink reservoir 222 as a result of executing the print job using the second color scheme is then projected or estimated, as depicted by reference numeral 320. A decision is then made, as depicted by decision block 322. The decision relates to the difference between the first ink level and the second ink level after execution of the print job using a second color scheme and the differences between the same two ink levels after executing the print job using the first color scheme. Basically, determination is made whether the difference between the first ink level and the second ink level after executing the print job using the second color scheme, is less than the difference between the first ink level and the second ink level after executing the print job using the first color scheme. If the result of decision box 322 is yes, then another decision box 324 is encountered. Decision box 324 is a determination of the limitations imposed that prevent performing the print job using the second color scheme. If, in fact, the limitations do prevent use of the second color scheme, the print job is executed using the first color scheme, as depicted by reference numeral 326.

Similarly, if the estimated difference between the first ink level and the second ink level after executing the print job using the second color scheme is not less than the estimated difference between the first ink level and the second ink level after executing the print job using the first color scheme, then the print job is executed using the first color scheme, as depicted by reference numeral 326. In summary, if the output of decision box 322 is no, then the print job is executed using the first color scheme 326. If there are no limitations imposed which prevent using the second color scheme, then the print job is executed using the second color scheme, as depicted by reference numeral 328. Once the print job is executed using either the first color scheme, as depicted by reference numeral 326, or by using the second color scheme, as depicted by reference numeral 328, the process quits, as depicted by reference numeral 330.

It should be noted that the embodiment shown in FIG. 3 checks two ink levels namely, the first ink level and the second ink level. It should be understood that in a tricolor cartridge would include three reservoirs 221, 222, 223, three ink levels would be determined, and the process would include balancing or reducing the difference between all three levels for the particular color schemes.

Now turning back to FIG. 3, the decision regarding whether the limitations imposed prevent use of the second color scheme, which carries the reference numeral 324, will now be discussed in further detail. One of the limitations might be the type of image that is to be printed using the first color scheme or the given color scheme. For example, if the image is a replication or reproduction or if the image is a natural image or a logo, the user would not likely select an alternate color scheme or second color scheme. In this particular application, a table lookup of certain images could be provided that indicated a first color scheme or original color scheme would be used to print the particular image. In another embodiment, the image may be provided with a tag that indicates that the original color scheme or first color scheme would be used to print the image.

In other embodiments, the type of paper used can be an indication that an alternate or second color scheme would not be used. For example, if photographic paper is determined to be in the paper tray of the printer mechanism 256, a photograph is presumably being printed and, therefore, a second color scheme would not be used. As shown in FIG. 2, a media type sensor 2561 is able to sense the type of media or the paper associated or being used with a print job. The type of media sensor 2561 can include bar codes, labels, switch bumps, magnetically readable media, radio frequency labels, read-only chips, or a reflectivity sensor. Another type of media that would prevent the use of a second color scheme is a transparency.

Other limitations that may prevent the execution of the print job using a second color scheme might include various modes either enabled or disabled by the user of the printer. In some instances, the printer may include default values for the various modes. Therefore, the user would not necessarily have to enable or disable these modes initially. Draft mode is one mode that can be enabled or disabled by a user. The draft mode generally has an output from the print job which is rough, yet readable. In the draft mode, the colors are not necessarily the colors associated with the finished product, but are representative of the color. In addition, the dot pitch associated with the draft mode can be higher so that less ink is used in producing the draft. In other words, draft mode has an output from the print job which is rough yet readable, and which does not use as many consumables, such as individual inks. In draft mode, however, the output includes representative colors so that the output of the print job can be reviewed to make sure that it is aesthetically pleasing. In draft mode, a limitation imposed that can prevent the use of a second color scheme would be related to the colors. For example, given three colors, the color of the output is desired to be within a certain percentage of the various colors. This is generally user selectable and in some embodiments might be between 5–10%. Of course, in other embodiments, different percentages can be used. When the draft mode is enabled, different color schemes or a second color scheme can be employed which is within a certain percentage of the color and which uses a lesser amount of ink than the desired final output of the print job.

Another mode that can be enabled or disabled is the balance mode. In this particular mode, the user generally is interested in checking the content of the output of the print job as well as the placement of the content on a page or other print media. The balance mode, in some embodiments, does not have a requirement that the colors be within a certain amount of the first color scheme used. In the balance mode, the method described and shown in FIG. 3 is used to balance out the amount of ink in a plurality of reservoirs, such as in each of the reservoirs of a multi-colored cartridge. For example, in a tri-color cartridge, the ink levels in three reservoirs 221, 222, 223 will be balanced by selecting either the original color scheme or a second color scheme which will result in an equaling out or a lessening of the difference between the levels in the various reservoirs, such as 221, 222, and 223.

Figure 4:
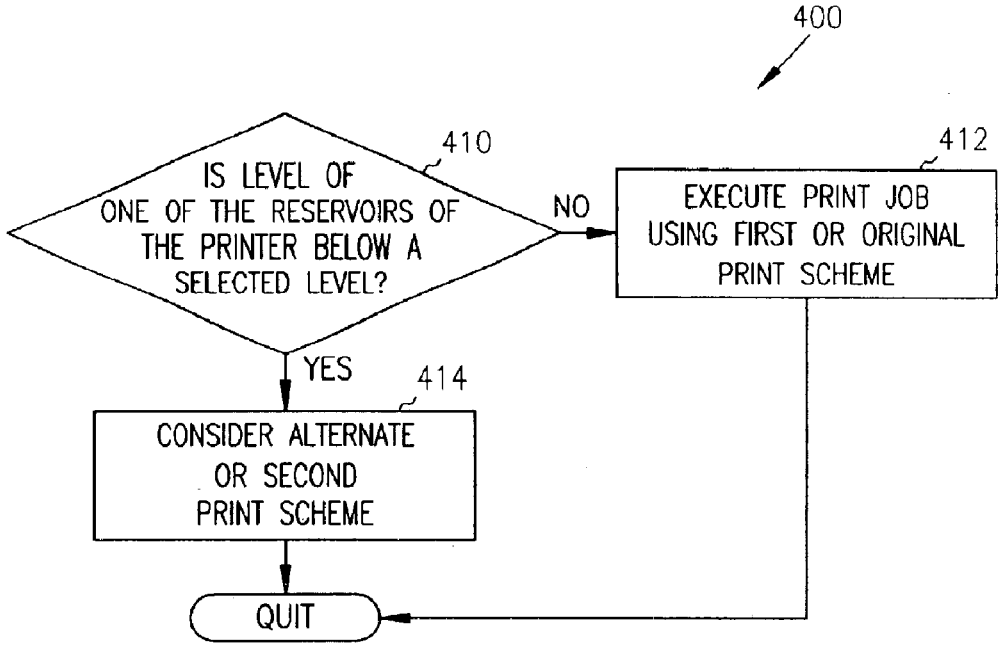
FIG. 4 is a flow diagram illustrating a method for implementing the invention according to another embodiment of the invention.

FIG. 4 is a flow diagram illustrating a method for implementing another embodiment of the invention. In some instances, the user may not desire to employ a scheme where the levels between the reservoirs are balanced or the differences between the reservoirs are reduced by selecting an alternate or second color scheme until certain events have occurred or until certain thresholds have been met. FIG. 4 is one implementation associated with one embodiment of the invention where a second color scheme or alternate color scheme is contemplated only at a certain time. FIG. 4 includes process 400 in which the level of one of the reservoirs 221, 222, 223 of the printer is checked to determine if it is below a selected level, as depicted by decision box 410. The selected level can be any level. If one of the reservoirs is not below the selected level, then the print job is executed using the original or first print scheme, as depicted by reference numeral 412. On the other hand, if the level of one of the reservoirs is below a selected level, then a second or alternate print scheme is considered, as depicted by reference numeral 414. The alternate or second print scheme is implemented if it will result in a lessening of the differences between the various levels of the reservoirs 220, 221, 222, 223 and provided there are no limitations which prevent using a second color scheme.

Figure 5:
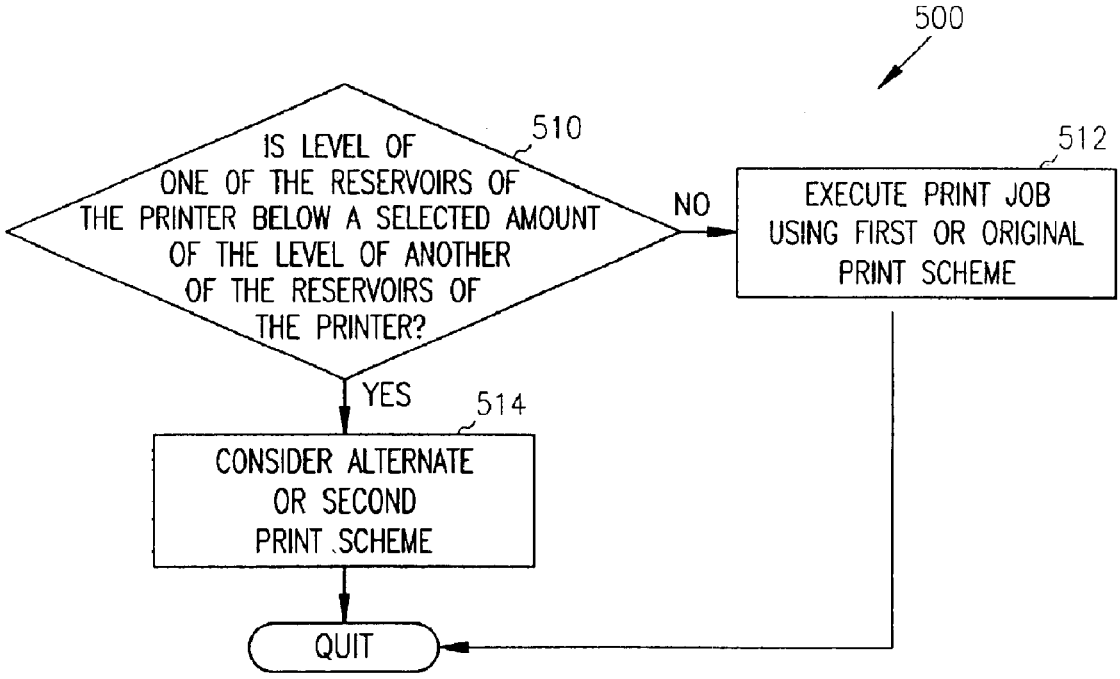
FIG. 5 is a flow diagram illustrating a method for implementing the invention according to another embodiment of the invention.

FIG. 5 is another flow diagram illustrating yet another method for implementing yet another embodiment of the invention. This particular embodiment includes process 500 where a decision is initially made as to whether the level of one of the reservoirs 220, 221, 222, 223 of the printer is below a selected amount of a level of another of the reservoirs 220, 221, 222, 223 of the printer, as depicted by reference numeral 510. If the level of one of the reservoirs is not below a selected amount of the level of another of the reservoirs, then the print job is executed using the first or original print scheme, as depicted by reference numeral 512. In the alternative, if the level of one of the reservoirs of the printer is below a selected amount of a level of another of the reservoirs of the printer, then an alternate or second print scheme is considered, as depicted by reference numeral 514. In this particular embodiment of the invention, a balancing scheme such as shown in the flow diagram of FIG. 3 is implemented when one of the reservoirs drops to a selected level below another reservoir or the other reservoirs. This can be used to prevent implementation of printing using a second color scheme since the selected difference will be an indication that the various reservoirs 220, 221, 222 are within a selected level of one another.

Figure 6:
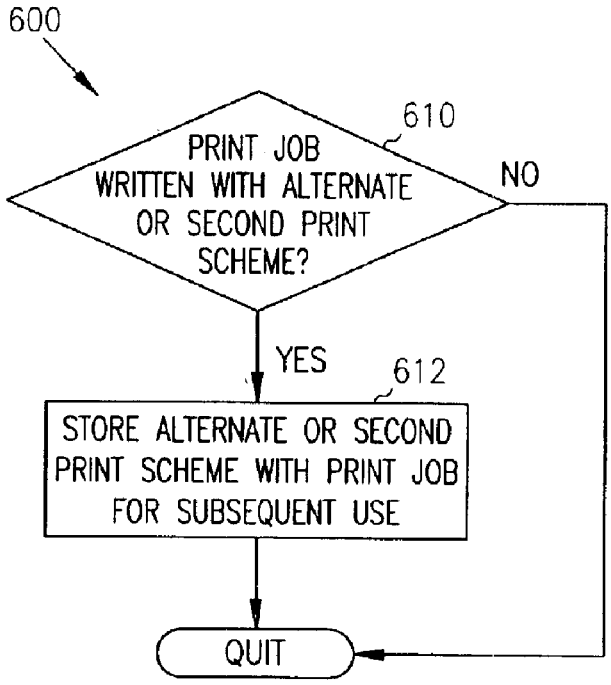
FIG. 6 is a flow diagram for yet another embodiment of this invention.

FIG. 6 is a flow diagram for yet another embodiment of the invention. In this embodiment of the invention, a further process 600 is added. The process includes a determination of whether or not the print job has been printed using an alternate or second print scheme, as depicted by decision box 610. If a second print scheme has been used or if the print job is executed using a second print scheme, the second print scheme is stored with the print job so that when the print job is called subsequently, the user has the option of selecting the alternate or second print scheme previously used, as depicted by reference numeral 612. This is advantageous when one or two pages may be changed in a large presentation and it is desired to execute a print job in which the pages that have been changed are printed once again. If the second or alternate print scheme is not used, then the process is ended.

Figure 7:
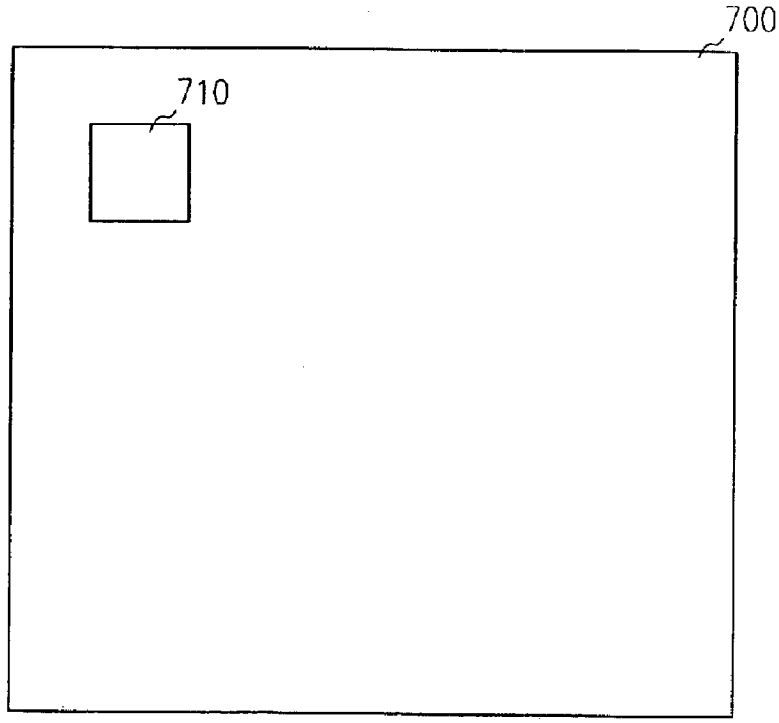
FIG. 7 is a schematic diagram illustrating a computer readable medium and associated instruction set according to an embodiment of the invention.

FIG. 7 is a schematic diagram illustrating a computer-readable medium 700, an associated instruction set 710, according to an embodiment of this invention. The computer-readable medium includes all forms of optical based memory, magnetic based memory, and semiconductor based memory. The computer-readable medium 700 can be any number of computer-readable medium such as a floppy drive, a hard disk drive, a network interface, an interface to the internet, or the like. The computer-readable medium can also be a hard-wired link for a network or be an infrared or radio frequency carrier. The instruction set 710 can be any set of instructions which are executable by an information handling system associated with the printing apparatus discussed. For example, the instruction set may include the method 300, 400, 500, and 600 discussed and any other embodiments discussed with respect to FIGS. 3–6 above. Other instruction sets may also be placed on the computer-readable medium 700.

A set of instructions for implementing the method may be stored either in the controller 230 of the printer 210 or it can be stored within host 270. When stored within the host, it is typically stored in the set of instructions referred to as the printer driver. The printer driver is the set of software or the set of instructions used to instruct the printer on the execution of print jobs. The printer driver can include default values which can be either enabled or disabled or changed subsequently by a user. Advantageously, and using the method and apparatus described above, the reservoirs 220, 221, 222, 223 of a multi-color printing mechanism, and specifically the reservoirs associated with multi-color cartridges, can be balanced either over the life or usage time of the multi-color cartridge or near the end of the life of a multi-color cartridge. This reduces the negative impression of the user in having to discard a multi-color cartridge in which one of the reservoirs still contains a relatively large amount of ink when compared to the other reservoirs of the multi-color cartridges. The consumer also has the benefit of having a multi-color cartridge which lasts for an elongated time frame.

A method for printing includes estimating ink usage for printing with a first color scheme and a second color scheme, and selecting between the first color scheme and the second color scheme for printing according to the estimating of the ink usage. Estimating the ink usage further includes estimating an amount of a first ink that will be used to print the first color scheme and the second color scheme, and estimating an amount of a second ink that will be used to print the first color scheme and the second color scheme. Selecting between the first color scheme and the second color scheme includes selecting the second color scheme when printing with the first color scheme results in a larger difference between the first ink level and the second ink level than when printing with the second color scheme. Selecting between the first color scheme and the second color scheme includes selecting the second color scheme when printing with the first color scheme results in a larger difference between the first ink level and the second ink level than when printing with the second color scheme. The method further includes monitoring a first ink level and a second ink level and selecting the one of the first color scheme and the second color scheme that the estimation of the usage of the first ink and the second ink indicates would result in a smaller difference between the first ink level and the second ink level. By changing to the second color scheme the level of the first ink is brought closer to the level of the second ink. The second color scheme may be stored. The second color scheme is associated with an original image so that a subsequent print command related to the original image replicates the second color scheme. The method further includes presenting the second color scheme as an option selectable by the user.

The method for printing also includes presenting the second color scheme as an option selectable by the user; and presenting a third color scheme as an option selectable by the user, wherein the user can select from one of the first color scheme, the second color scheme or the third color scheme. The method further includes setting a print mode wherein using the second color scheme for printing brings the level of the first ink and the level of the second ink of a multi-color print cartridge closer to one another than when using the first color scheme for printing. Criteria may be selected to prevent use of the second color scheme. The color associated with the second color scheme exists within a selected threshold of color of the first color scheme for use of the second color scheme. The dot pitch associated with the second color scheme may be less than the dot pitch associated with the first color scheme. In some embodiments, a paper type associated with the printing prevents use of the second color scheme. In other embodiments, a type of print job associated with the printing prevents use of the second color scheme. The method may be implemented when the first ink level or the second ink level drops below a selected threshold, or when the difference between the first ink level and the second ink level drops below a selected threshold.

A set of instructions executable on an information handling system, includes monitoring a first ink level and a second ink level of a multi-color ink cartridge, estimating an amount of the first ink to be used for printing using a first color scheme, estimating an amount of the second ink to be used for printing using the first color scheme, and changing to a second color scheme different from the first color scheme if the estimating of the first ink and the second ink indicates a larger difference between the first ink level and the second ink level than printing using the first color scheme. The set of instructions further includes a computer readable medium. The computer readable medium includes the set of instructions.

A method for printing multiple colors includes determining an amount of the first ink that will be used to execute a print command using a first color scheme, determining an amount of the second ink that will be used to execute the print command using the first color scheme, monitoring a first ink level, monitoring a second ink level, and executing the print command using a second color scheme different from the first color scheme when execution of the print command using the first color scheme would result in a larger difference between the first ink level and the second ink level than execution of the print command using the second color scheme. Executing the print command using the second color scheme may be presented as a selectable option to a user interface associated with a printer. The method may be implemented when the first ink level or the second ink level drops below a selected threshold. The method for printing may also be implemented when the difference between the first ink level and the second ink level drops below a selected threshold. In some embodiments, a balance mode may be selected. The method is implemented when the balance mode is enabled.

A multi-color printing apparatus includes a first sensor for determining a level of a first ink, a second sensor for determining a level of a second ink, and means for carrying a print job. The means for carrying a print job further includes means for estimating the amount of the first ink and the amount of the second ink used if the print job is executed using a first color scheme, and means for estimating the amount of the first ink and the amount of the second ink used if the print job is executed using a second color scheme, and means for selecting between executing the print job using the first color scheme and executing the print job using the second color scheme. The means for selecting between the print job using the first color scheme and the print job using the second color scheme includes a controller selecting the print job which results in the least amount of difference between the first ink level and the second ink level. In some embodiments, the means for selecting between the print job using the first color scheme and the print job using the second color scheme includes a controller querying the user to select the print job which results in the least amount of difference between the first ink level and the second ink level. In still other embodiments, means for selecting between the print job using the first color scheme and the print job using the second color scheme includes a controller selecting a color scheme for the print job that results in a lesser amount of difference between the first ink level and the second ink level, and which is within a selected level of the color. The means for selecting between the print job using the first color scheme and the print job using the second color scheme may also include means for setting a mode to direct a controller to select a color scheme for the print job that results in a lesser amount of difference between the first ink level and the second ink level. The means for setting a mode also includes selecting a level of the color for the second color scheme that is within a desired range of the first color scheme.

An apparatus includes a first sensor to measure a level of a first ink, a second sensor to measure a level of a second ink, and a processor coupled to the first sensor and the second sensor and configured to estimate usage of the first ink and the second ink using a first color scheme and a second color scheme and configured to select the first color scheme or the second color scheme for use in printing according to the estimate of the usage of the first ink and the second ink. The apparatus further includes a first reservoir for holding a first ink, the first sensor positioned to detect the level of the first ink in the first ink reservoir, and a second reservoir for holding a second ink, the second sensor positioned to detect the level of the second ink in the second ink reservoir. The apparatus further includes a print head in fluid communication with the first reservoir and the second reservoir. In another embodiment, the apparatus further includes a print head in fluid communication with the first reservoir and the second reservoir, the print head electrically coupled to the processor, wherein the print head is configured to use of a first amount of the first ink and a first amount of the second ink for a first color scheme, and wherein the print head is configured to use of a second amount of the first ink and a second amount of the second ink for a second color scheme. The first reservoir, the second reservoir and the print head are part of a print cartridge. In another embodiment, the apparatus further includes a first print head in fluid communication with the first reservoir, and a second print head in fluid communication with the second reservoir, the first print head and the second print head communicatively coupled to the processor, wherein the first print head is configured to use of a first amount of the first ink and the second print head is configured to use a first amount of the second ink for a first color scheme, and wherein the first print head is configured to use of a second amount of the first ink and the second print head is configured to use a second amount of the second ink for a second color scheme. The first reservoir, the second reservoir, the first print head, and the second print head are part of a print cartridge.

An imaging system includes a processor, a memory communicatively coupled to the processor, a first sensor to measure a level of a first ink, and a second sensor to measure a level of a second ink, the processor coupled to the first sensor and the second sensor, the processor programmable to estimate usage of the first ink and the second ink using a first color scheme and a second color scheme, and programmable to select the first color scheme or the second color scheme for use in printing in response to the estimate of the usage of the first ink and the second ink. The imaging system further includes a first reservoir for holding a first ink, the first sensor adapted to detect the level of the first ink in the first ink reservoir, and a second reservoir for holding a second ink, the second sensor adapted to detect the level of the second ink in the second ink reservoir. The memory of the imaging system is adapted to store a second color scheme. The memory of the imaging system may also be adapted to store a plurality of color schemes associated with a print job.

Although specific embodiments have been illustrated and described herein, those of ordinary skill in the art will appreciate that any arrangement calculated to achieve the same purpose can be substituted for the specific embodiments shown. This disclosure is intended to cover any and all adaptations or variations of various embodiments of the invention. It is to be understood that the above description has been made in an illustrative fashion, and not a restrictive one. Combinations of the above embodiments, and other embodiments not specifically described herein will be apparent to those of skill in the art upon reviewing the above description. The scope of various embodiments of the invention includes any other applications in which the above structures and methods are used. Therefore, the scope of various embodiments of the invention should be determined with reference to the appended claims, along with the full range of equivalents to which such claims are entitled.

It is emphasized that the Abstract is provided to comply with 37 C.F.R. §1.72(b) requiring an Abstract that will allow the reader to quickly ascertain the nature and gist of the technical disclosure. It is submitted with the understanding that it will not be used to interpret or limit the scope or meaning of the claims.

In the foregoing Detailed Description, various features are grouped together in a single embodiment for the purpose of streamlining the disclosure. This method of disclosure is not to be interpreted as reflecting an intention that the claimed embodiments of the invention require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separate preferred embodiment.

What is claimed is:

1. A method for printing comprising:

estimating ink usage for printing with a first color scheme and a second color scheme, wherein estimating the ink usage further includes estimating an amount of an ink that will be used to print the first color scheme and the second color scheme; and selecting between the first color scheme and the second color scheme for printing according to the estimating of the ink usage.

2. The method of claim 1 wherein selecting between the first color scheme and the second color scheme includes selecting the second color scheme when printing with the first color scheme results in a larger difference between the first ink level and the second ink level than when printing with the second color scheme.

3. The method of claim 1 further comprising monitoring a first ink level and a second ink level, selecting the one of the first color scheme and the second color scheme that an estimation of the usage of the first ink and the second ink indicates would result in a smaller difference between the first ink level and the second ink level.

4. The method for printing of claim 1 wherein changing to the second color scheme brings the level of the first ink closer to the level of the second ink.

5. The method for printing of claim 1 further comprising storing the second color scheme.

6. The method for printing of claim 1 further comprising associating the second color scheme with an original image so that a subsequent print command related to the original image replicates the second color scheme.

7. The method for printing of claim 6 wherein the color associated with the second color scheme exists within a selected threshold of color of the first color scheme for use of the second color scheme.

8. The method for printing of claim 6 wherein the dot pitch associated with the second color scheme is less than the dot pitch associated with the first color scheme.

9. The method for printing of claim 6 wherein a paper type associated with the printing prevents use of the second color scheme.

10. The method for printing of claim 6 wherein a type of print job associated with the printing prevents use of the second color scheme.

11. The method for printing of claim 1 further comprising presenting the second color scheme as an option selectable by the user.

12. The method for printing of claim 1 further comprising:

presenting the second color scheme as an option selectable by the user; and presenting a third color scheme as an option selectable by the user, wherein the user can select from one of the first color scheme, the second color scheme or the third color scheme.

13. The method for printing of claim 1 further comprising setting a print mode wherein using the second color scheme for printing brings the level of the first ink and the level of the second ink of a multi-color print cartridge closer to one another than when using the first color scheme for printing.

14. The method for printing of claim 1 further comprising selecting criteria to prevent use of the second color scheme.

15. The method for printing of claim 1 implemented when the first ink level or the second ink level drops below a selected threshold.

16. The method for printing of claim 1 implemented when the difference between the first ink level and the second ink level drops below a selected threshold.

17. A method for printing comprising:

estimating ink usage for printing with a first color scheme and a second color scheme, wherein estimating the ink usage further comprises:

estimating an amount of a first ink that will be used to print the first color scheme and the second color scheme; and estimating an amount of a second ink that will be used to print the first color scheme and the second color scheme; and selecting between the first color scheme and the second color scheme for printing according to the estimating of the ink usage.

18. The method of claim 17, wherein selecting between the first color scheme and the second color scheme includes selecting the second color scheme when printing with the first color scheme results in a larger difference between the first ink level and the second ink level than when printing with the second color scheme.

19. A set of instructions executable on an information handling system, comprising:

monitoring a first ink level and a second ink level of a multi-color ink cartridge;

estimating an amount of the first ink to be used to print a first color scheme and a second color scheme;

estimating an amount of the second ink to be used to print the first color scheme and the second color scheme;

changing to the second color scheme different from the first color scheme if the estimating of the first ink and the second ink indicates a larger difference between the first ink level and the second ink level than printing using the first color scheme.

20. The set of instructions executable on an information handling system of claim 19 further including a computer readable medium, the computer readable medium including the set of instructions.

21. A method for printing multiple colors comprising:

estimating an amount of the first ink that will be used to execute a print command using a first color scheme;

estimating an amount of the second ink that will be used to execute the print command using the first color scheme;

monitoring a first ink level;

monitoring a second ink level; and executing the print command using a second color scheme different from the first color scheme when execution of the print command using the first color scheme would result in a larger difference between the first ink level and the second ink level than execution of the print command using the second color scheme.

22. The method of claim 21 wherein executing the print command using the second color scheme is presented as a selectable option to a user interface associated with a printer.

23. The method of claim 21 implemented when the first ink level or the second ink level drops below a selected threshold.

24. The method for printing of claim 21 implemented when the difference between the first ink level and the second ink level drops below a selected threshold.

25. The method of claim 21 further comprising selecting a balance mode where the method is implemented when the balance mode is enabled.

26. A multi-color printing apparatus comprising:

a first sensor for determining a level of a first ink;

a second sensor for determining a level of a second ink; and means for carrying a print job further comprising:

means for estimating the amount of the first ink and the amount of the second ink used if the print job is executed using a first color scheme; and means for estimating the amount of the first ink and the amount of the second ink used if the print job is executed using a second color scheme;

means for selecting between executing the print job using the first color scheme and executing the print job using the second color scheme.

27. The multi-color printing apparatus of claim 26 wherein means for selecting between the print job using the first color scheme and the print job using the second color scheme includes a controller selecting the print job which results in the least amount of difference between the first ink level and the second ink level.

28. The multi-color printing apparatus of claim 26 wherein means for selecting between the print job using the first color scheme and the print job using the second color scheme includes a controller querying the user to select the print job which results in the least amount of difference between the first ink level and the second ink level.

29. The multi-color printing apparatus of claim 26 wherein means for selecting between the print job using the first color scheme and the print job using the second color scheme includes a controller selecting a color scheme for the print job that results in a lesser amount of difference between the first ink level and the second ink level, and which is within a selected level of the color.

30. The multi-color printing apparatus of claim 26 wherein means for selecting between the print job using the first color scheme and the print job using the second color scheme includes means for setting a mode to direct a controller to select a color scheme for the print job that results in a lesser amount of difference between the first ink level and the second ink level.

31. The multi-color printing apparatus of claim 30 wherein means for setting a mode also includes selecting a level of the color for the second color scheme that is within a desired range of the first color scheme.

32. An apparatus, comprising:

a first sensor to measure a level of a first ink;

a second sensor to measure a level of a second ink;

a third sensor to determine a type of media used by the apparatus; and a processor coupled to the first sensor and the second sensor and configured to estimate usage of the first ink and the second ink using a first color scheme and a second color scheme, the processor also coupled to the third sensor and configured to select the first color scheme or the second color scheme for use in printing according to the estimate of the usage of the first ink and the second ink and the type of media.

33. The apparatus of claim 32 further comprising:

a first reservoir for holding a first ink, the first sensor positioned to detect the level of the first ink in the first ink reservoir; and a second reservoir for holding a second ink, the second sensor positioned to detect the level of the second ink in the second ink reservoir.

34. The apparatus of claim 33 further comprising a print head in fluid communication with the first reservoir and the second reservoir.

35. An apparatus, comprising:

a first sensor to measure a level of a first ink;

a second sensor to measure a level of a second ink;

a processor coupled to the first sensor and the second sensor and configured to estimate usage of the first ink and the second ink using a first color scheme and a second color scheme, and configured to select the first color scheme or the second color scheme for use in printing according to the estimate of the usage of the first ink and the second ink;

a first reservoir for holding a first ink, the first sensor positioned to detect the level of the first ink in the first ink reservoir;

a second reservoir for holding a second ink, the second sensor positioned to detect the level of the second ink in the second ink reservoir; and a print head in fluid communication with the first reservoir and the second reservoir, the print head electrically coupled to the processor, wherein the print head is configured to use of a first amount of the first ink and a first amount of the second ink for a first color scheme, and wherein the print head is configured to use of a second amount of the first ink and a second amount of the second ink for a second color scheme.

36. The apparatus of claim 35 wherein the first reservoir, the second reservoir and the print head are part of a print cartridge.

37. An apparatus, comprising:

a first sensor to measure a level of a first ink;

a second sensor to measure a level of a second ink;

a processor coupled to the first sensor and the second sensor and configured to estimate usage of the first ink and the second ink using a first color scheme and a second color scheme, and configured to select the first color scheme or the second color scheme for use in printing according to the estimate of the usage of the first ink and the second ink;

a first reservoir for holding a first ink, the first sensor positioned to detect the level of the first ink in the first ink reservoir;

a second reservoir for holding a second ink, the second sensor positioned to detect the level of the second ink in the second ink reservoir;

a first print head in fluid communication with the first reservoir; and a second print head in fluid communication with the second reservoir, the first print head and the second print head communicatively coupled to the processor, wherein the first print head is configured to use of a first amount of the first ink and the second print head is configured to use a first amount of the second ink for a first color scheme, and wherein the first print head is configured to use of a second amount of the first ink and the second print head is configured to use a second amount of the second ink for a second color scheme.

38. The apparatus of claim 37 wherein the first reservoir, the second reservoir, the first print head, and the second print head are part of a print cartridge.

39. An imaging system, comprising:

a processor;

a memory communicatively coupled to the processor;

a first sensor to measure a level of a first ink; and a second sensor to measure a level of a second ink, the processor coupled to the first sensor and the second sensor, the processor programmable to estimate usage of the first ink and the second ink using a first color scheme and a second color scheme, and programmable to select the first color scheme or the second color scheme for use in printing in response to the estimate of the usage of the first ink and the second ink.

40. The imaging system of claim 39 further comprising:

a first reservoir for holding a first ink, the first sensor adapted to detect the level of the first ink in the first ink reservoir; and a second reservoir for holding a second ink, the second sensor adapted to detect the level of the second ink in the second ink reservoir.

41. The imaging system of claim 39 wherein the memory is adapted to store a second color scheme.

42. The imaging system of claim 39 wherein the memory is adapted to store a plurality of color schemes associated with a print job.

43. A method for printing comprising:

estimating ink usage for printing with a first color scheme and a second color scheme;

determining a media type; and selecting between the first color scheme and the second color scheme for printing in response to the media type and the estimating of the ink usage.

44. A method for printing comprising:

enabling a draft mode;

estimating ink usage for printing with a first color scheme and a second color scheme; and selecting between the first color scheme and the second color scheme for printing in response to the media type and the estimating of the ink usage.

45. The method for printing of claim 44 wherein enabling the draft mode includes selecting limitations associated with parameters of the draft mode.

* * * * *

UNITED STATES PATENT AND TRADEMARK OFFICE

CERTIFICATE OF CORRECTION

PATENT NO. : 6,991,319 B2
APPLICATION NO. : 10/405274
DATED : January 31, 2006
INVENTOR(S) : Wendy L. Zerza et al.

It is certified that error appears in the above-identified patent and that said Letters Patent is hereby corrected as shown below:

In column 13, line 8, in Claim 26, after "carrying" insert -- out --.

In column 14, line 24, in Claim 35, after "use" delete "of".

In column 14, line 26, in Claim 35, after "use" delete "of".

In column 14, line 54, in Claim 37, after "use" delete "of".

In column 14, line 59, in Claim 37, after "use" delete "of".

Signed and Sealed this

Fourteenth Day of September, 2010

David J. Kappos

David J. Kappos
*Director of the United States Patent and Trademark Office*